US005132721A

United States Patent [19]

Randall

[11] Patent Number: 5,132,721

[45] Date of Patent: Jul. 21, 1992

[54] MULTIPURPOSE IMAGING APPARATUS

[75] Inventor: Kent A. Randall, Webster, N.Y.

[73] Assignee: Eastman Kodak Company, Rochester, N.Y.

[21] Appl. No.: 601,630

[22] Filed: Oct. 22, 1990

[51] Int. Cl.[5] ..... G03G 21/00

[52] U.S. Cl. ..... 355/24; 355/275; 355/326

[58] Field of Search ..... 355/217, 244, 271, 272, 355/274, 275, 319, 326, 327, 328, 24

[56] References Cited

U.S. PATENT DOCUMENTS

| | | | |
|---|---|---|---|
| 3,940,210 | 2/1976 | Donohue | 355/319 X |
| 4,078,787 | 3/1978 | Burlew et al. | 355/207 X |
| 4,531,828 | 7/1985 | Hoshino | 355/272 X |
| 4,580,889 | 4/1986 | Hiranuma et al. | 355/327 |
| 4,674,857 | 6/1987 | Satomura et al. | 355/271 |
| 4,688,925 | 8/1987 | Randall | 355/319 |
| 4,714,939 | 12/1987 | Ahern et al. | 355/275 |
| 4,777,510 | 10/1988 | Russel | 355/328 |
| 4,987,455 | 1/1991 | Lubberts | 355/271 |

FOREIGN PATENT DOCUMENTS 0159862 8/1985 Japan .

OTHER PUBLICATIONS

Ronald A. Andrews, Xerox Disclosure Journal, vol. 9, No. 1, Single Pass Duplex in Electronic Systems, Jan.-/Feb. 1984, pp. 47-48.

*Primary Examiner*—R. L. Moses
*Assistant Examiner*—J. E. Barlow, Jr.
*Attorney, Agent, or Firm*—Leonard W. Treash, Jr.

[57] ABSTRACT

Imaging apparatus includes a primary image member upon which first and second toner images are formed and an intermediate image member to which one of said toner images is transferred. Duplex imaging is accomplished by transferring one image from the primary image member to one side of a receiving sheet and a second image from the intermediate image member to the other side. The intermediate image member extends toward a fuser to transport the receiving sheet to the fuser while the first image is being transferred. Both images are transferred to the receiving sheet while not being backed by the other image member. In a full-color portion four different color toner images are formed and transferred in registration to form a multicolor image which is transferred to the intermediate image member permitting the apparatus to function in either a high-volume simplex or duplex imaging mode or in a low-volume, full-color imaging mode.

8 Claims, 3 Drawing Sheets

MULTIPURPOSE IMAGING APPARATUS

RELATED APPLICATIONS

This application is related to co-assigned: U.S. patent application Ser. No. 07/601,539, filed Oct. 22, 1990, METHOD AND APPARATUS FOR HANDLING TONER IMAGES, in the name of Kent A. Randall now U.S. Pat. No. 5,070,371.

U.S. patent application Ser. No. 07/601,538, filed Oct. 22, 1990, IMAGING APPARATUS UTILIZING INTERMEDIATE TRANSFER MEMBER, in the name of Kent A. Randall.

U.S. patent application Ser. No. 07/601,629, filed Oct. 22, 1990, A METHOD AND APPARATUS FOR FORMING COMBINED TONER IMAGES, in the name of Kent A. Randall now U.S. Pat. No. 5,070,372.

TECHNICAL FIELD

This invention relates to electrostatographic apparatus capable of handling a variety of printing or copying jobs.

BACKGROUND ART

High volume electrophotographic copiers, duplicators and printers are presently manufactured to produce from 50,000 to one million images a month and more at high speed. Some can do duplex at full machine speed and "highlight" color at a reduced speed.

For example, U.S. Pat. No. 4,078,787, Burlew et al, issued Mar. 14, 1978, shows a commercially known electrophotographic copier in which a photoconductive belt is entrained around a series of rollers. Toner images are formed on the belt electrophotographically and are transferred to a receiving sheet which is brought into contact with and carried by the belt for a portion of its path. Copiers and printers similar to this apparatus presently do duplex imaging at over 100 images a minute.

In such apparatus, the belt is entrained about a one-inch roller just after the transfer station. The receiving sheet has a tendency not to follow the photoconductive belt as it goes around the small roller and is picked up by a transport belt, one edge of which is positioned just above the small roller. The transport belt holds the non-image bearing side of the receiving sheet and transports it away from the photoconductive belt to a fixing device, for example, a roller fuser.

U.S. Pat. No. 4,714,939, Ahern et al, issued Dec. 22, 1987, shows a high volume copier not yet adopted commercially. In order to do duplex copying with a straight receiving sheet path, an intermediate transfer roller or belt is positioned in transfer relation with the photoconductive belt. A first toner image is transferred to the intermediate member and the receiving sheet is fed between the photoconductive belt and the intermediate member. The first image is transferred to the topside of the receiving sheet and a second toner image is transferred to the bottom side of the receiving sheet. With this approach, duplex images can be formed on a receiving sheet with the receiving sheet passing through a straight paper path. Because toner images are electrostatically transferred in opposite directions to opposite sides of the same sheet, the intermediate roller or belt is positioned to separate from the image member before the toner image is transferred to the receiving sheet from the photoconductive belt. This reduces the tendency of the other toner image to be transferred back to the intermediate under influence of the electrostatic field transferring the toner image from the photoconductive belt. See also U.S. Pat. No. 4,688,925, Randall, issued Aug. 25, 1987.

A number of references describe a process for making two (or more) color images by creating an electrostatic image and toning the electrostatic image in the presence of a previously created toner image of a different color. U.S. patent application Ser. No. 07/341,452 to Ahern, filed Apr. 21, 1989, and entitled "Color Duplex Reproduction Method and Apparatus", discloses using that process with an intermediate belt or roller to do multicolor duplex toner images using a straight paper path.

The duplex copiers and printers described above are designed to operate at high speeds and high volumes. Such apparatus generally has a large capacity paper supply, a heavy-duty fuser and are quite reliable despite very high volume applications.

U.S. Pat. No. 4,531,828, Hoshino, issued Jul. 30, 1985, and U.S. Pat. No. 4,580,889, Hiranuma et al, issued Apr. 8, 1986, are representative of a number of references which show the use of four separate photoconductive drums for creating single color toner images which are then transferred in registration to a receiving sheet or an intermediate member to a form multicolor image.

Four-color printers and copiers are generally relatively slow speed. However, they still require a relatively heavy-duty fuser in order to fuse images made up of four different toners.

STATEMENT OF THE INVENTION

It is an object of the invention to provide an apparatus that is adapted for high-volume duplex printing and copying as well as high quality multicolor imaging.

This object is accomplished by a multipurpose imaging apparatus which includes a primary image member and an intermediate image member similar in some respects to that suggested in the prior art. First and second electrostatic images are created on the primary image member with the first electrostatic image being transferred to the intermediate image member. The apparatus also includes an independent imaging means for forming a multicolor toner image on the intermediate image member. The apparatus has at least first and second modes of operation. In the first mode a receiving sheet is fed from a receiving sheet supply into contact with the primary image member and the intermediate image member to receive toner images on opposite sides creating duplex reproductions. In the second mode, a multicolor toner image is transferred from the intermediate image member to one side of the receiving sheet as it moves along the same receiving sheet path as in the first mode.

With this apparatus the same receiving sheet supply, fixing device and straight receiving sheet path can be used in both high-speed, high-volume duplex reproduction and in relatively slow-speed, high-quality, full-color reproduction.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
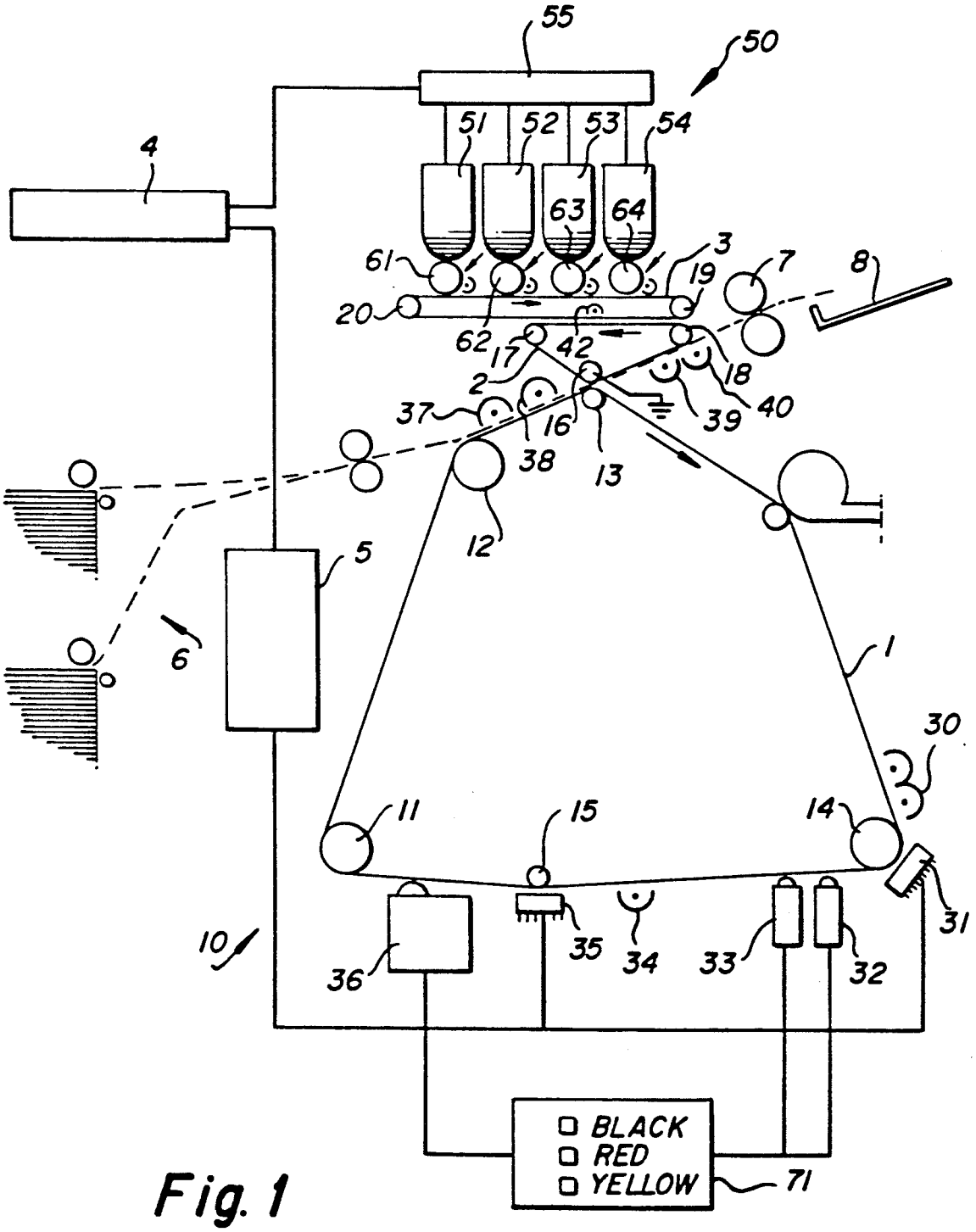
FIG. 1 is a side schematic of a multipurpose imaging apparatus constructed according to the invention.

According to FIG. 1, a multipurpose imaging apparatus includes a high volume duplex copier or printer portion 10 and a full color portion 50. The copier or printer portion 10 includes a primary image member, for example, photoconductive belt 1, which is entrained about a series of rollers including rollers 11, 12, 13, 14 and 15 and is driven by one of said rollers past a series of known electrophotographic stations.

In single color operation, primary image member 1 is uniformly charged by a primary charger 30 and imagewise exposed at an exposure station, for example, LED electronic exposure station 31 to create a series of electrostatic images. The images are toned by a heavy-duty toning station 36, which may contain a large supply of black toner for heavy-duty, high-volume use.

In simplex operation, a receiving sheet is fed from a receiving sheet supply 6 to a transfer station including a transfer corona charger 37 where a toner image is transferred from primary image member 1 to the bottom-side of the receiving sheet. The receiving sheet passes a detack charger 38 and separates from primary image member 1 as primary image member 1 moves around a small roller 13. The receiving sheet is electrostatically attracted to an intermediate image member 2 which in this application is functioning to transport the receiving sheet to a duplex fuser 7 which fixes the image on the receiving sheet and deposits the sheet in an output tray 8.

Intermediate image member 2 is entrained about rollers 16, 17 and 18. Roller 16 is positioned sufficiently close to roller 13 supporting primary image member 1 that primary image member 1 and intermediate image member 2 are brought into contact or near contact with each other.

In the duplex mode, instead of transferring a first toner image to a receiving sheet, it is transferred to intermediate image member 2 utilizing the strength of an electric field created between rollers 13 and 16. A transfer sheet is fed into contact with primary image member 1 as a second toner image approaches transfer charger 37. The second toner image is transferred to the bottom-side of the transfer sheet by transfer charger 37 and the topside of the receiving sheet adheres to intermediate image member 2 as primary image member 1 passes around roller 13. The receiving sheet now overlies the first toner image on intermediate image member 2. A second transfer corona charger 39 is biased to a polarity which transfers the first toner image to the topside of the receiving sheet from intermediate image member 2. The sheet passes a detack charger 40 and separates from intermediate image member 2 as the intermediate image member passes around roller 18. The sheet moves into duplex fuser 7 where both images are simultaneously fused.

Note that in the duplex application, the intermediate image member 2 serves the function both of an intermediate transfer member and as a transport for transporting the receiving sheet to the fuser. Transfer of the first toner image is carried out at a position removed from primary image member 1. Thus, the electrostatic field created by transfer charger 39 does not remove the second toner image from the receiving sheet. Without the presence of primary image member 1, it has nowhere to go. Note also that the second toner image was transferred to the receiving sheet by transfer charger 37 at a position at which the sheet was not backed by intermediate member 2; thus, the first toner image is not affected thereby.

Primary image member 1 can also be used to make two-color reproductions, either simplex or duplex. In this mode, primary image member 1 is first charged by primary charging station 30 and imagewise exposed by exposure station 31 to create a first electrostatic image. The first electrostatic image is toned by one of toner stations 32 or 33. Toning stations 32 and 33 have different highlight colors, for example, red and yellow. A color control 71 permits the operator to select which color is used to tone the first electrostatic image. Assuming station 32 has red toner and is selected, a red toner image is formed corresponding to the electrostatic image created by exposure station 31.

Primary image member 1 is then recharged by a secondary charging station 34 (primarily to equalize the charge in the toned and untoned areas) and is again imagewise exposed by a second exposure station 35, which may also be an LED electronic exposure station, to create a second electrostatic image in the same general area (i.e., the same frame) as the red toner image. Black toner is now applied from primary toning station 36 utilizing known toning technology which does not clean off the red toner image thereby creating a two-color image of red and black. If toning station 33 is used, the image will be yellow and black. This system is known in the art and is best utilized with electronic exposure and discharged area toning systems in creating highlight color reproductions. In this mode, consecutive two-color images can be formed. Utilizing intermediate image member 2, they can be transferred to opposite sides of a receiving sheet to create duplex two-color reproductions.

Single color images can also be formed by toning stations 32 and 33 as selected by the operator using color control 71 to pick either red or yellow without black. Three color images could be formed with additional charging and exposure stations.

The full-color portion 50 of the multipurpose imaging apparatus shown in FIG. 1 also uses the intermediate image member 2. As shown in FIG. 1, four separate single color toner images are created on separate photoconductive drums 61, 62, 63 and 64 by separate image-forming modules 51, 52, 53 and 54 which include a corona charger, a laser exposure device and a single color toning device for each of drums 61, 62, 63 and 64.

The separate toner images, which are conventionally cyan, magenta, yellow and black toner images are transferred in registration to a secondary image transfer member 3 to form a four-color toner image thereon. Secondary image transfer member 3 is entrained about rollers 19 and 20 and is positioned in transfer relation with intermediate image member 2.

In operation, the four-color image formed on member 3 is transferred by a transfer corona charger 42 to intermediate image member 2. From intermediate image member 2 the four-color toner image is transferred to a receiving sheet utilizing duplex transfer charger 39 as in the duplex mode with copier/printer portion 10.

Electronic exposure is used in both portions 10 and 50. The information for such exposure can come from any conventional printer source, for example, a suitable memory, a computer or a scanner. As shown in FIG. 1, a color scanner 4 feeds signals both to color image processing electronics 55 for portion 50 and to compiler 5 for portion 10. Obviously, two separate scanners could be used or either of the portions connected to some other electronic image source.

Note that in the duplex mode, images intended for opposite sides of a receiving sheet must be reversed when formed, because the images transferred to intermediate image member 2 go through an additional transfer with respect to those transferred directly from primary image member 1 to a receiving sheet. U.S. Pat. No. 4,714,939, Ahern, issued Dec. 22, 1987, shows optics for performing such an every-other-image reversal with an optical copier. However, if exposure is by electronic exposure devices, this reversal is accomplished by appropriate electronic programming.

Although the full-color portion 50 is shown with an intermediate member 3 which is separate from the intermediate image member 2, their functions can be merged into a single component. That is, the four toner images formed on drums 61, 62, 63 and 64 could be transferred directly to intermediate image member 2. This is a matter of design choice. For greatest efficiency of the high volume portion 10 of the apparatus, it is preferable that intermediate image member 2 be only one frame in length. It would be difficult to fit all four drums 61–64 in contact with an intermediate image member small enough to do small images from primary image member 1 at full machine speed. However, the intermediate image member could be made two frames in size to accommodate such direct transfer. With the image member two frames in size, the high volume portion 10 would operate at full efficiency for all duplex imaging except when a single two-sided receiving sheet is imaged, in which case one frame must be skipped. Note that if a multipage duplex document is being printed with a two frame intermediate, the images would be printed in 2 sheet batches with two odd numbered pages (say, 1, 3) done before two even numbered pages (say, 2, 4), or vice versa.

Figure 2:
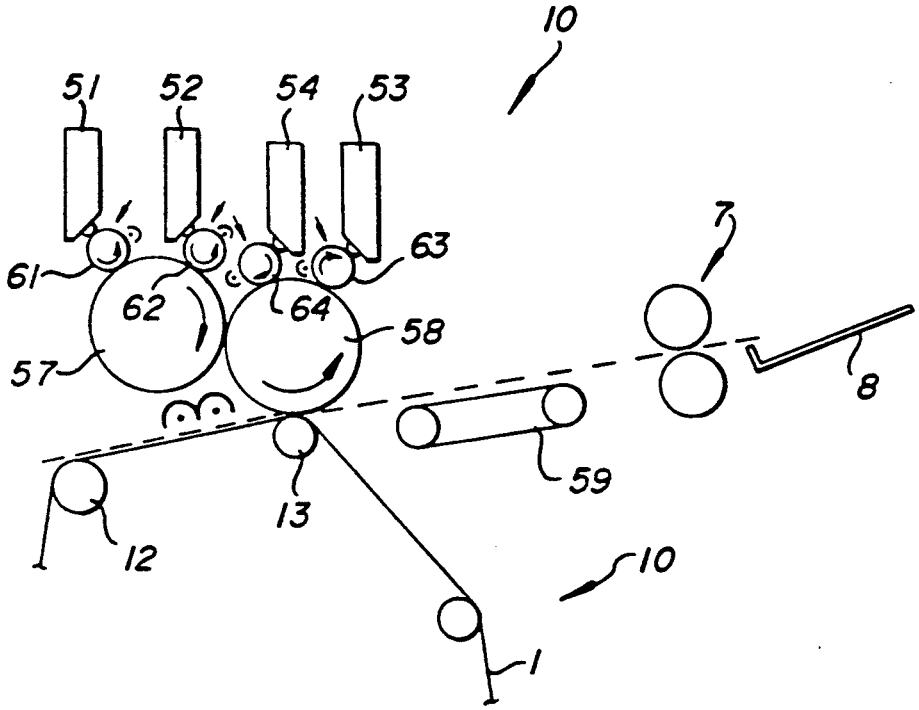
FIGS. 2, 3 and 4 are side schematics of a portion of three alternative embodiments of the apparatus shown in FIG. 1.

FIG. 2 shows an alternative machine geometry for the full-color portion of the apparatus shown in FIG. 1. According to FIG. 2, intermediate image member 2 is replaced by an intermediate image drum 58 which cooperates with a secondary intermediate drum 57 to combine the toner images from photoconductive drums 61, 62, 63 and 64.

As shown in FIG. 2, first and second color toner images are transferred from drums 61 and 62 in registration to drum 57 to create a two-color image. Single color toner images are also transferred from drums 63 and 64 in registration to form a two-color image on drum 58. The two-color image on drum 57 is transferred to drum 58 in registration with the two color image transferred from drums 63 and 64 to form a four color image which in turn is transferred to a receiving sheet being carried by primary image member 1 between drum 58 and small roller 13. The receiving sheet is transported to the fuser by a transport 59 of a type presently used in the art to transport sheets having unfixed toner images on both sides.

The FIG. 2 embodiment has the advantage of using rollers for combining the images from drums 61–64 which facilitates cross track and skew registration of the images. However, it has the disadvantage, compared to the FIG. 1 embodiment, of requiring an independent transport 59 to move the sheet to the fuser. In the FIG. 2 embodiment, intermediate transfer drum 58 is utilized with primary image member 1 to provide duplex reproductions as in the FIG. 1 embodiment and therefore must be equal in size to the pitch of the images on primary image member 1. Drums 57, 63 and 64 do not interfere with this process because transfer biases between those drums and drum 58 are turned off when using image member 1 for primary imaging. Note that this embodiment also does not have the advantage of the FIG. 1 apparatus of transferring the first duplex toner image to the receiving sheet when the receiving sheet is not backed by primary image member 1.

Figure 3:
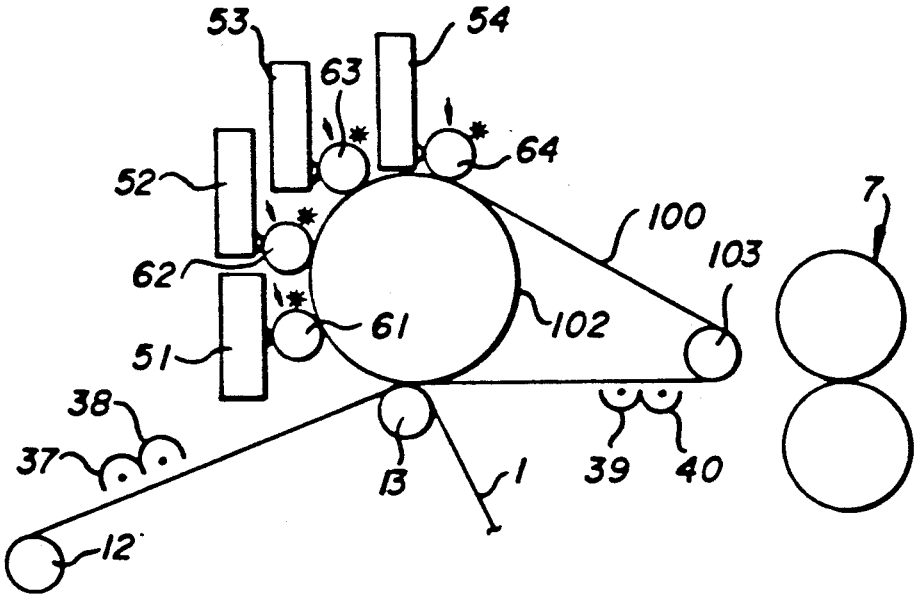
Figure 4:
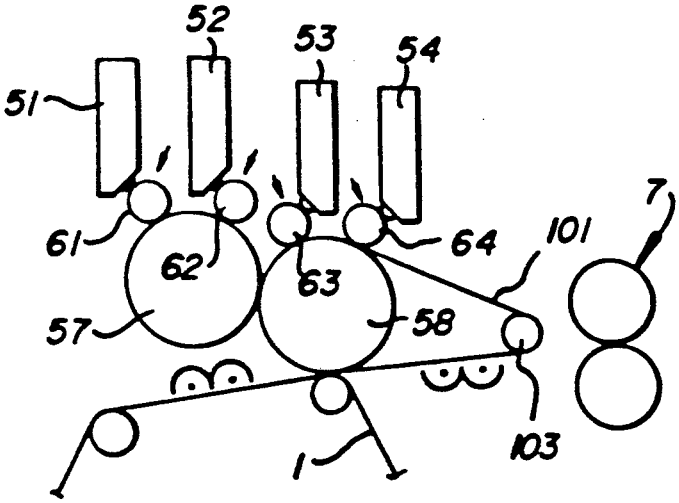

FIGS. 3 and 4 show a combination of FIGS. 1 and 2. According to FIG. 3, a single intermediate web 101 is trained around a large drum 102 and a small roller 103. All four color toner forming drums 61–64 are in transfer relation with web 101 where it is backed by large drum 102. This facilitates excellent cross track and skew registration of the color images. The web and small roller configuration facilitates transport of a transfer sheet to the fuser 7 and separation of the transfer sheet from web 101. The large drum and web increases the access time for a single duplex copy and requires doing imaging in an order other than ordinary numerical order for greatest productivity.

FIG. 4 shows a combination of FIGS. 2 and 3 in which two drums are used as in FIG. 2, but the second one supports a web as in FIG. 3. This approach reduces the height of the apparatus and the length of web 101.

Each of the four constructions has the substantial advantage of utilizing the same heavy-duty fuser 7 and substantial receiving sheet supply 6 as well as receiving sheet mechanisms for both the high-volume printer portion 10 and the high-quality full-color portion 50. In addition, the FIGS. 1, 3 and 4 embodiments have the advantage that the intermediate image members 2 and 101 also function as the transport mechanism for moving receiving sheets in all modes from the primary image member 1 to the fuser 7.

Many jobs include a mixture of text, text using highlight color and a few full color images. This apparatus can be programmed to provide such a single job using both portions of the apparatus and provide completed sets in an output tray or a finisher. Accomplishing this without a collator and without skipping frames would require a multipage buffer for the high volume portion 10.

FIGS. 1–4 show a full color portion 50 in which the full color image is formed by forming separate single color images on separate drums. However, the full color image could also be formed by other means. For example, a single photoconductive drum or belt could form the images consecutively on its surface and transfer them in registration to the intermediate member at a single transfer station in four steps.

The invention has been described in detail with particular reference to a preferred embodiment thereof, but it will be understood that variations and modifications can be effected within the spirit and scope of the invention as described hereinabove and as defined in the appended claims.

I claim:

1. A multipurpose imaging apparatus comprising:

a primary image member, an intermediate image member, means for forming electrostatic images on said primary image member, means for toning said electrostatic images to form toner images on said primary image member, color imaging means, independent of said primary image member for forming a multicolor toner image on said intermediate image member, a receiving sheet supply, means for feeding a receiving sheet through a path in which one side of said receiving sheet faces said primary image member and the other side of said receiving sheet faces said intermediate image member, a first means, in a first mode of operation, for transferring a first toner image from said primary image member to said intermediate image member and then from said intermediate image member to one side of such a receiving sheet fed along said path, and for transferring a second toner image from said primary image member to the other side of the same receiving sheet, and a second means, in a second mode of operation, for transferring a multicolor toner image from said intermediate image member to the first side of such a receiving sheet fed along said path.

2. Apparatus according to claim 1 wherein said apparatus includes a fixing means and both said primary image member and said intermediate image member are endless belts and said primary image member is entrained about a series of rollers including a small roller which assists in separation of a sheet therefrom, and said intermediate image member is entrained about a series of rollers one of said rollers being adjacent said small roller and said intermediate member extending toward said fixing means from said one roller to receive said receiving sheet from said primary image member as said primary image member passes around said small roller and transport said receiving sheet to the fixing means.

3. Apparatus according to claim 1 wherein said color imaging means includes a plurality of single color image devices, each image device including a color image member and means for forming a toner image on said color image member, each toner image on each of the respective color image members being of a color different from the color of the toner images on the other color image members, and a third means for transferring said toner images from said color image members in registration to a secondary intermediate member to form a multicolor image thereon, and a fourth means for transferring said multicolor image from said secondary intermediate member to said intermediate image member.

4. Apparatus according to claim 3 wherein each of said single color image devices includes a photoconductive drum, a charging means, an exposing means and a toning means for creating a single color toner image on said photoconductive drum.

5. Apparatus according to claim 4 wherein each of said exposing means includes laser exposing means.

6. Apparatus according to claim 1 further including means for forming an additional electrostatic image on said primary image member in an area of said primary image member already containing a toner image and means for toning said additional electrostatic image with a color of toner different from the toner image already in said area to create a two-color toner image on said primary image member.

7. Apparatus according to claim 6 wherein said means for forming electrostatic images includes an electronic exposure means.

8. Apparatus according to claim 6 including at least two toning stations, positioned to alternatively tone a single electrostatic image.

* * * * *